US008110732B2

(12) United States Patent
Shimoda

(10) Patent No.: US 8,110,732 B2
(45) Date of Patent: Feb. 7, 2012

(54) KEYBOARD DEVICE FOR ELECTRONIC KEYBOARD INSTRUMENT

(75) Inventor: Yoshiaki Shimoda, Hamamatsu (JP)

(73) Assignee: Kabushiki Kaisha Kawai Gakki Seisakusho, Shizuoka (JP)

( * ) Notice: Subject to any disclaimer, the term of this patent is extended or adjusted under 35 U.S.C. 154(b) by 0 days.

(21) Appl. No.: 12/838,201

(22) Filed: Jul. 16, 2010

(65) Prior Publication Data

US 2011/0017049 A1 Jan. 27, 2011

(30) Foreign Application Priority Data

Jul. 22, 2009 (JP) ..... 2009-171487

(51) Int. Cl.
*G10D 3/00* (2006.01)

(52) U.S. Cl. ..... 84/423 R

(58) Field of Classification Search ..... 84/424, 84/425, 427–438
See application file for complete search history.

(56) References Cited

U.S. PATENT DOCUMENTS 5,542,332 A * 8/1996 Tamai et al. ..... 84/435

FOREIGN PATENT DOCUMENTS

JP 3085033 7/2000

* cited by examiner

*Primary Examiner* — Kimberly Lockett
(74) *Attorney, Agent, or Firm* — Christie, Parker & Hale, LLP.

(57) ABSTRACT

A keyboard device for an electronic keyboard instrument, ensuring stable pivotal motion of each key and improved in each of assembly and disassembly. Each key extends in a front-rear direction and has a pivot shaft extending at a rear end in a left-right direction. A keyboard chassis has a mounting portion and key-separating support portions each for supporting the pivot shaft. A pivot shaft bearing member has a pivot shaft support portion cooperating with each key-separating support portion to form a bearing for the pivot shaft, supporting each key pivotally movable, and is removably mounted to the mounting portion. During assembly, with each key engaged with the key-separating support portion via the pivot shaft and held on the keyboard chassis, the mounting portion remains exposed, enabling the bearing member to be mounted from above or rear.

6 Claims, 4 Drawing Sheets

KEYBOARD DEVICE FOR ELECTRONIC KEYBOARD INSTRUMENT

CROSS-REFERENCE TO RELATED APPLICATION

This application claims priority of Japanese Patent Application Number 171487/2009, filed on Jul. 22, 2009.

BACKGROUND OF THE INVENTION

1. Field of the Invention

The present invention relates to a keyboard device for an electronic keyboard instrument applied e.g. to an electronic piano, and more particularly to a key support structure for pivotally supporting keys.

2. Description of the Related Art

Conventionally, there has been known a keyboard device for an electronic keyboard instrument, disclosed in Japanese Patent Publication No. 3085033. This keyboard device is applied to a pedal keyboard for an electronic musical instrument, and comprises a frame and a plurality of keys pivotally supported on the frame and arranged side by side in a left-right direction. Each of the keys extends in a front-rear direction and has a rear end thereof formed with a pivot that extends in the left-right direction and has a circular cross section. Further, the frame has a rear end formed in a manner covering the rear ends of the respective keys from the rear to above, and inside the rear end of the frame, there are formed a pair of left and right support portions for supporting the pivot of each key. Each of the support portions has an arcuate curved surface in the shape of a quarter circle in side view, and is configured to support the pivot of an associated key obliquely from the rear and above by the arcuate curved surface. Further, between the pair of support portions is attached a pivot bearing piece that cooperates with the support portions to support the pivot of the associated key. The pivot bearing piece has an arcuate curved surface in the shape of a half circle in side view, and is configured to support the pivot of the key from below by the arcuate curved surface.

In the keyboard device constructed as above, the three arcuate curved surfaces of the two support portions and the pivot bearing piece on the frame side function as a bearing for supporting the pivot of the associated key. With this arrangement, when stepped on to operate for musical performance, each key of the keyboard device performs relatively stable pivotal motion about the axis of the pivot of the rear end thereof.

In the keyboard device, work for mounting each key to the frame during assembly of the keyboard device is performed as follows: First, a key is set on the frame such that the pivot thereof is positioned close to the arcuate curved surfaces of the two support portions of the frame. Then, the pivot bearing piece is inserted from below into a guide groove formed between the two support portions. Thereafter, the pivot bearing piece is slid upward along the guide groove, until it is stopped by the lower end thereof being snap-coupled to the edge of a keybed integral with a partition plate provided inside the frame. Thus, the pivot bearing piece is fixed to the frame, and the key is mounted to the frame.

In this keyboard device, although each key can be securely mounted to the frame in a pivotally movable manner, the work for mounting the keys to the frame during assembly of the keyboard device is complicated. More specifically, in order to mount each key to the frame, as described above, it is required to insert the pivot bearing piece into the guide groove between the two support portions from below, for the frame on which the key is set. In this case, the guide groove is surrounded on the front, rear, left, right, and top sides thereof by the rear end of the frame, the set key, and the partition plate, and so forth, which makes it difficult for a worker to view the position of the guide groove. For this reason, in the case of inserting the pivot bearing piece into the guide groove, the worker has to look into the guide groove from below the frame or grope for the guide groove to confirm the position of the same. Particularly in the case of mounting the pivot bearing pieces one by one for the respective keys, the work therefor is very complicated, and hence it takes much time and labor for assembling the keyboard device. Further, the pivot bearing piece snap-coupled to the keybed is difficult to remove due to its construction, which makes it difficult to disassemble the keyboard device into the frame and the keys e.g. when disposing of the electronic musical instrument.

SUMMARY OF THE INVENTION

It is an object of the present invention to provide a keyboard device for an electronic keyboard instrument, which ensures stable pivotal motion of each key and makes it possible to increase the ease of assembly and disassembly of the keyboard device at the same time.

To attain the above object, the present invention provides a keyboard device for an electronic keyboard instrument, comprising a plurality of keys that each extend in a front-rear direction and each have a pivot shaft extending at a rear end thereof in a left-right direction, a keyboard chassis that includes a mounting portion and a plurality of first support portions each provided on a key-by-key basis so as to support the pivot shaft, and holds the keys in a state arranged side by side in the left-right direction, and a pivot shaft bearing member that includes a second support portion which cooperates with each first support portion to form a bearing for supporting the pivot shaft, to thereby support each key in a manner pivotally movable about the axis of the pivot shaft, and is removably mounted to the mounting portion, wherein during assembly of the keyboard device, in a state where each key is engaged with an associated one of the first support portions via the pivot shaft and is held on the keyboard chassis, the mounting portion remains exposed to outside before the pivot shaft bearing member is mounted thereto, such that the pivot shaft bearing member can be mounted from above or rear.

With this arrangement, the keys each extending in the front-rear direction has the pivot shaft extending at the rear end thereof in the left-right direction, and the keyboard chassis for holding the keys in a state arranged side by side in the left-right direction has the first support portions each formed on a key-by-key basis so as to support the pivot shaft. Further, the pivot shaft bearing member removably mounted to the mounting portion of the keyboard chassis has the second support portion which cooperates with each first support portion to form a bearing for supporting the pivot shaft of each key, to thereby support the key in a manner pivotally movable about the axis of the pivot shaft. Thus, the respective pivot shafts of the keys can be securely supported by the first support portions of the keyboard chassis and the second support portion of the pivot shaft bearing member, so that it is possible to ensure stable pivotal motion of each key.

Further, during assembly of the keyboard device, in a state where each key is engaged with the associated first support portion via the pivot shaft and is held on the keyboard chassis, the mounting portion remains exposed to outside before the pivot shaft bearing member is mounted thereto. In addition, the pivot shaft bearing member can be mounted to the mounting portion from above or rear. This enables a worker in charge of assembling the keyboard device to easily view the position of the mounting portion, and mount the pivot shaft bearing member to the mounting portion by bringing the former close to the latter from above or rear, when mounting the pivot shaft bearing member to the mounting portion of the keyboard chassis. Furthermore, the pivot shaft bearing member is removable from the mounting portion, and therefore, e.g. in the case of disposing the electronic keyboard instrument, the bearing formed by the first and second support portions is discomposed by dismounting the pivot shaft bearing member from the keyboard chassis, whereby the keys can be easily removed from the keyboard chassis. As described above, according to the keyboard device of the present invention, it is possible to increase the ease of assembly and disassembly while securing stable pivotal motion of each key, in comparison with the prior art.

Preferably, the pivot shaft is formed such that left and right ends thereof protrude from respective left and right side walls of the key, and each first support portion comprises two side wall portions left and right erected on a mounting surface in a manner opposed to each other in the left-right direction with a predetermined spacing therebetween, and left and right first arcuate surfaces protruding from the two side wall portions, respectively, in a manner opposed to each other, for sliding contact with respective outer peripheral surfaces of the ends of the pivot shaft, wherein the second support portion has a second arcuate surface opposed to the first arcuate surfaces, for sliding contact with an outer peripheral surface of the pivot shaft, and is disposed between the mounting surface and the pivot shaft, in a state placed on the mounting surface.

With this arrangement, each first support portion of the keyboard chassis has the left and right first arcuate surfaces, while the second support portion of the pivot shaft bearing member has the second arcuate surface opposed to the first arcuate surfaces. In this case, the two first arcuate surfaces are held in sliding contact with the outer peripheral surfaces of the respective ends of the pivot shaft protruding from the respective left and right side walls of the key, and the second arcuate surface is held in sliding contact with the outer peripheral surface of the pivot shaft. Thus, by virtue of a bearing surface formed by the two left and right first arcuate surfaces and the second arcuate surface, the pivot shaft can be supported in a well-balanced manner by the three arcuate surfaces of the bearing surface. Further, the left and right first arcuate surfaces are formed in a manner protruding from the respective left and right side wall portions erected on the mounting surface, while the second support portion formed with the second arcuate surface is disposed between the mounting surface and the pivot shaft in a state placed on the mounting surface integrally formed with the first arcuate surfaces via the respective side wall portions. This makes it possible to immovably support the first arcuate surfaces and the second arcuate surface in the radial direction of the pivot shaft to thereby easily form the bearing surface for stably supporting the pivot shaft.

More preferably, each side wall portion is disposed such that a clearance is formed between the side wall portion and an end face of the pivot shaft opposed thereto, and each first arcuate surface is disposed such that a clearance is formed between a protruding end face thereof and the side wall of the key opposed thereto.

With this arrangement, a clearance is formed between each of the side wall portions and the end face of the pivot shaft opposed thereto, and a clearance is formed between the protruding end face of each of the first arcuate surfaces and the side wall of the key opposed thereto. This makes it possible to prevent abrasion due to contact between each side wall portion and the pivot shaft and between each first arcuate surface and the side wall of the key opposed thereto, and thereby ensure smooth and stable pivotal motion of the key.

More preferably, one of the mounting portion and the pivot shaft bearing member is provided with a positioning portion to be brought into contact with the other of the mounting portion and the pivot shaft bearing member when the pivot shaft bearing member is mounted to the mounting portion, to thereby dispose the second arcuate surface concentrically with the first arcuate surfaces.

With this arrangement, when the pivot shaft bearing member is mounted to the mounting portion of the keyboard chassis, the positioning portion formed in one of the mounting portion and the pivot shaft bearing member is brought into contact with the other, whereby the second arcuate surface of the second support portion is disposed concentrically with the first arcuate surfaces of the first support portion. This makes it possible to easily form the bearing surface for properly supporting the pivot shaft, by the first and second arcuate surfaces.

Preferably, the pivot shaft bearing member has a plurality of the second support portions.

With this arrangement, since the pivot shaft bearing member has a plurality of second support portions, it is possible to form a plurality of bearings for supporting the pivot shafts of a plurality of keys, respectively, simply by mounting the pivot shaft bearing member to the mounting portion of the keyboard chassis. Therefore, the ease of assembly and disassembly of the keyboard device can be further increased in comparison with a case where pivot shaft bearing members each formed with a single second support portion are mounted one by one to the mounting portion of the keyboard chassis or dismounted one by one from the same.

Preferably, the keyboard chassis further comprises two lateral swing-suppressing portions front and rear formed in association with each key in a manner spaced from each other in the front-rear direction, so as to suppress lateral swing of the key during key depression.

With this arrangement, the keyboard chassis has the two lateral swing-suppressing portions front and rear formed in association with each key in a manner spaced from each other in the front-rear direction. This make it possible to effectively suppress undesired unstable motion, such as lateral swing or tilt, of the key during key depression, to thereby ensure more stable pivotal motion of the key.

The above and other objects, features, and advantages of the present invention will become more apparent from the following detailed description taken in conjunction with the accompanying drawings.

BRIEF DESCRIPTION OF THE DRAWINGS

FIGS. 1A and 1B are side views of a keyboard device for an electronic piano, according to an embodiment of the present invention, in which;

FIG. 1A shows a key-released state of a white key; and

FIG. 1B shows a key-depressed state of the white key;

DETAILED DESCRIPTION OF PREFERRED EMBODIMENTS

Figure 1A:
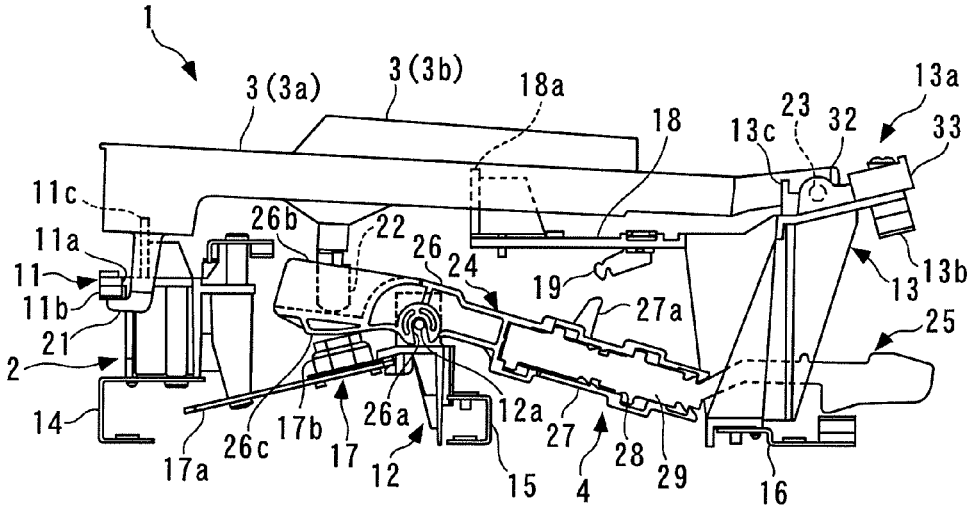
Figure 1B:
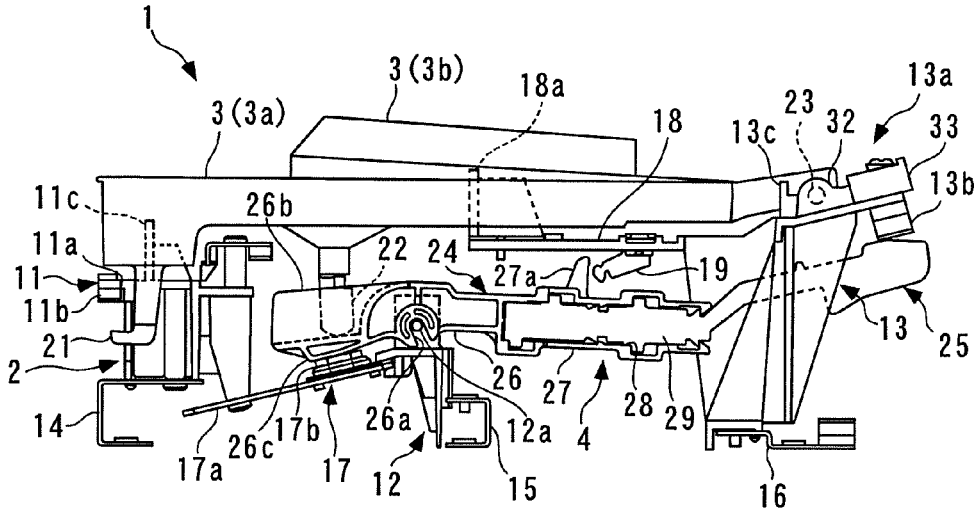

The present invention will now be described in detail with reference to the drawings showing a preferred embodiment thereof. FIGS. 1A and 1B show a keyboard device for an electronic piano, according to the embodiment of the present invention. As shown in FIGS. 1A and 1B, the keyboard device 1 includes a keyboard chassis 2, a plurality of (e.g. eighty-eight) keys 3 pivotally mounted on the keyboard chassis 2 and including white keys 3*a* and black keys 3*b*, and a plurality of hammers 4 (only one of which is shown) each provided for an associated one of the keys 3 and pivotally mounted on the keyboard chassis 2.

In the following, a description will be given of the outline of the arrangement and operation of the keyboard device 1 first, and then of a support structure for supporting each key 3 by the keyboard chassis 2 and a method of mounting the keys 3 to the keyboard chassis 2 during assembly of the keyboard device 1, with reference to FIGS. 1A and 1B.

The keyboard chassis 2 is a resin molded article in a predetermined shape which is formed by injection molding of a predetermined resin material (e.g. ABS resin). The keyboard chassis 2 has a front part (left part as viewed in FIGS. 1A and 1B) 11 thereof, a central part 12 thereof, and a rear part (right part as viewed in FIGS. 1A and 1B) 13 thereof integrally formed in a state connected to each other by ribs (not shown), and is rigidly secured on a keybed of an electronic piano, not shown, via a front mounting rail 14, a central mounting rail 15, and a rear mounting rail 16 each extending in a left-right direction (depth direction as viewed in FIGS. 1A and 1B). It should be noted that in the following description, the front part 11, the central part 12, and the rear part 13 of the keyboard chassis 2 will be referred to as "the chassis front part 11", "the chassis central part 12", and "the chassis rear part 13", respectively.

The chassis front part 11 has a plurality of pairs of engaging holes 11*a*, each pair of which comprises two engaging holes 11*a* left and right (only one of which is shown in FIGS. 1A and 1B) vertically extending through the chassis front part 11 and is provided for an associated white key 3*a*. Through the left and right engaging holes 11*a* are inserted respective left and right upper limit position-restricting portions 21, referred to hereinafter, of the associated white key 3*a*. Further, the chassis front part 11 has a key stopper 11*b* formed e.g. of felt and attached to the bottom of a front-portion of a rim of each of the engaging hole 11*a*. The upper limit position-restricting portions 21 of the white key 3*a* are brought into abutment with the key stopper 11*b* from below when in a key-released state, whereby the upper limit position of the white key 3*a* is restricted. Furthermore, the chassis front part 11 has a plurality of front guides 11*c* (lateral swing-suppressing portion: only one of which is shown in FIGS. 1A and 1B) erected therefrom in association with the respective white keys 3*a* so as to prevent lateral swing of the white keys. Each of the front guides 11*c* has approximately the same width as the lateral inner width (width in the left-right direction) of the white key 3*a*, and is inserted in the associated white key 3*a* from below.

The chassis central part 12 has a support shaft 12*a* extending in the left-right direction, and the hammers 4 are pivotally supported on the support shaft 12*a*. Further, key switches 17 extending toward the chassis front part 11 are mounted on the chassis central part 12, for detecting key depression information on the respective associated keys 3. Each of the key switches 17 comprises a printed circuit board 17*a* and a switch body 17*b* which is formed by a rubber switch and attached to the printed circuit board 17*a*, for an associated one of the keys 3. The key switch 17 is mounted to the keyboard chassis 2 with the rear end of the printed circuit board 17*a* inserted in the chassis central part 12 and the front end of the same screwed to the chassis front part 11.

The chassis rear part 13 has a key support section 13*a* that supports a pivot shaft 23, referred to hereinafter, provided on the rear end of each key 3, to thereby support the key 3 in a manner pivotally movable about the axis of the pivot shaft 23. Further, a hammer stopper 13*b* formed e.g. of felt is attached to the rear end of the lower surface of the key support section 13*a*. Furthermore, the chassis rear part 13 has two rear guides 13*c* left and right (lateral swing-suppressing portion: only one of which is shown in FIGS. 1A and 1B) located forward of the key support section 13*a* and erected at respective locations leftward and rightward of the rear end of each key 3 so as to prevent lateral swing of the key 3.

Between the chassis rear part 13 and the chassis central part 12, there is disposed a flat plate 18 extending substantially horizontally between the keys 3 and the hammers 4. This flat plate 18 has a plurality of front guides 18*a* (lateral swing-suppressing portion: only one of which is shown in FIGS. 1A and 1B) erected from the front end thereof in association with the respective black keys 3*b* so as to prevent lateral swing of the black keys 3*b*. Similarly to the front guide 11*c* for each white key 3*a*, each of the front guides 18*a* has approximately the same width as the lateral inner width of the black key 3*b*, and is inserted in the associated black key 3*b* from below.

It should be noted that a plurality of let-off members 19 (only one of which is shown in FIGS. 1A and 1B) each formed of an elastic material are mounted to the flat plate 18 in association with the respective hammers 4 in a manner protruding obliquely downward and forward from the lower surface of the same. When a hammer 4 that pivotally moves along with key depression comes into temporary engagement with an associated one of the let-off members 19 during the pivotal motion, let-off feeling is added to the touch feeling of the depressed key 3.

Each key 3 is formed e.g. by injection molding of a predetermined resin material (e.g. AS resin) such that it has a hollow shape extending in the front-rear direction and opening downward. The white key 3*a* has a front end thereof formed with the pair of left and right upper limit position-restricting portions 21 and 21 (only one of which is shown in FIGS. 1A and 1B). The left and right upper limit position-restricting portions 21 and 21 extend downward from the respective left and right side walls of the white key 3*a* and each have a lower end thereof bent forward. The left and right upper limit position-restricting portions 21 and 21 are engaged with the respective left and right engaging holes 11*a* and 11*a* of the chassis front part 11, in respective states extending therethrough. Further, the white key 3*a* has an actuator portion 22 formed at a predetermined location thereof rearward of the upper limit position-restricting portions 21 in a manner protruding downward, and the actuator portion 22 is engaged with an engaging recess 26*b*, referred to hereinafter, of the hammer 4 in a state received therein. Furthermore, the key 3 has the rear end thereof provided with the pivot shaft 23 extending in the left-right direction. It should be noted that in each black key 3*b*, portions corresponding to the upper limit position-restricting portions 21 and the actuator portion 22 of the white key 3*a* are integrally formed with respective lower portions of the front end thereof.

Each hammer 4 comprises a hammer body 24 and a weight 25 removably attached to the hammer body 24. The hammer body 24 is a resin molded article in a predetermined shape formed e.g. by injection molding of a predetermined resin material (e.g. POM (polyacetal resin)). The hammer body 24 extends in the front-rear direction and has a shaft bearing portion 26*a* formed at a predetermined location in a front half (left half as viewed in FIGS. 1A and 1B) 26 thereof and having an inverted U shape in side view, and the shaft bearing portion 26*a* is pivotally engaged with the support shaft 12*a* of the chassis central part 12. The engaging recess 26*b* for engagement with the actuator portion 22 of the key 3 is formed in the front half 26 of the hammer body 24 at a location forward of the shaft bearing portion 26*a*. The engaging recess 26*b* is open upward and forward, and the lower part of the actuator portion 22 of the key 3 is received in the engaging recess 26*b* in a state where the lower end of the actuator portion 22 is held in contact with the bottom surface of the engaging recess 26*b*. Further, formed under the engaging recess 26*b* in the front half 26 of the hammer body 24 is a switch pressing portion 26*c* for pressing the switch body 17*b* of the key switch 17.

A weight mounting portion 27 forming the rear half of the hammer body 24 has an opening 28 open rightward (frontward as viewed in FIGS. 1A and 1B), and the weight 25 is removably mounted to the hammer body 24 via the opening 28. Further, an engaging protrusion 27*a* for engagement with the let-off member 19 during key depression is formed on the weight mounting portion 27 of the hammer body 24 at a predetermined location in a manner protruding upward from the weight mounting portion 27.

On the other hand, the weight 25 is formed of a material (steel or the like material) having a larger specific gravity than that of the hammer body 24. The weight 25 is formed into a predetermined shape by pressing a metal plate having a smaller thickness than the thickness (thickness in the depth direction as viewed in FIGS. 1A and 1B) of the hammer body 24. The weight 25 extends in the front-rear direction and has a front half thereof formed as a mounted portion 29 mounted in the weight mounting portion 27 of the hammer body 24. The weight 25 extends rearward from the mounted portion 29 to a location near the rear end of the chassis rear part 13, and has a rear end thereof formed to have a relatively large vertical width (width in an up-down direction).

In the keyboard device 1 constructed as above, when a key 3 (the white key 3*a* in FIG. 1A) is depressed in the key-released state shown in FIG. 1A, the key 3 pivotally moves counterclockwise, as viewed in FIG. 1A, about the axis of the pivot shaft 23 of the rear end of the key 3, as shown in FIG. 1B. In accordance with this pivotal motion of the key 3, the actuator portion 22 of the key 3 presses the engaging recess 26*b* of the hammer 4 downward. As a consequence, the hammer 4 presses the switch body 17*b* of the key switch 17 from above by the switch pressing portion 26*c* while pivotally moving counterclockwise about the support shaft 12*a* of the chassis central part 12. In this case, the rear end of the hammer 4 (i.e. the rear end of the weight 25) is brought into abutment with the hammer stopper 13*b* of the chassis rear part 13 from below, whereby further pivotal motion of the hammer 4 is prevented. The key depressing operation described above makes it possible to impart a predetermined touch weight corresponding to the weight and torque of the hammer 4 to the key 3 and detect key depression information on the key 3 via the key switch 17 at the same time.

On the other hand, when the depressed key 3 is released, the hammer 4 pivotally moves clockwise, as viewed in FIG. 1B. In accordance with this pivotal motion of the hammer 4, the key 3 is pushed upward via the actuator portion 22 and pivotally moves clockwise. As a consequence, each of the key 3 and the hammer 4 returns to its key-released position as shown in FIG. 1A. In this case, the upper limit position-restricting portions 21 of the front end of the key 3 are brought into abutment with the key stopper 11*b* of the chassis front part 11 from below, whereby further pivotal motion of the key 3 is prevented.

Figure 2:
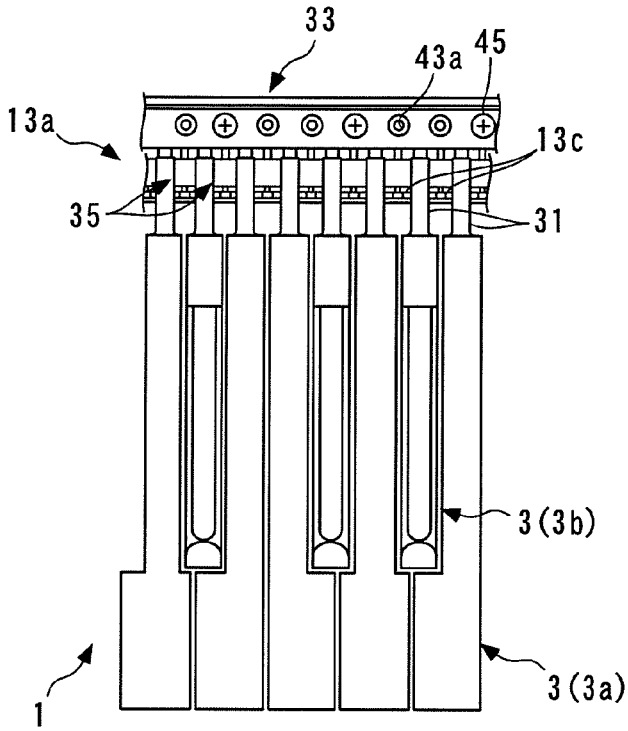
FIG. 2 is a partial plan view of the keyboard device.
Figure 3:
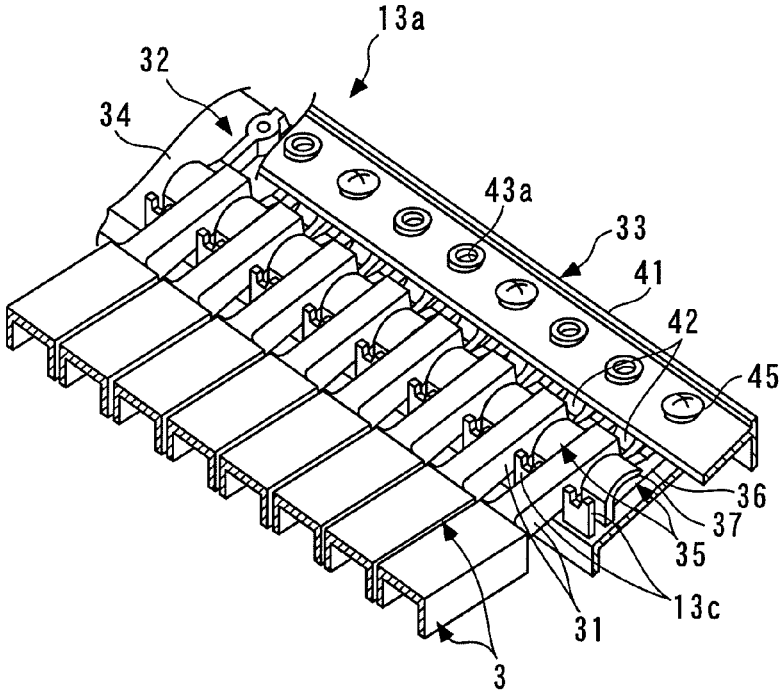
FIG. 3 is a perspective view of the keyboard device shown in FIG. 2, in which rear portions of the respective keys and associated components surrounding them are illustrated on an enlarged scale.
Figure 4:
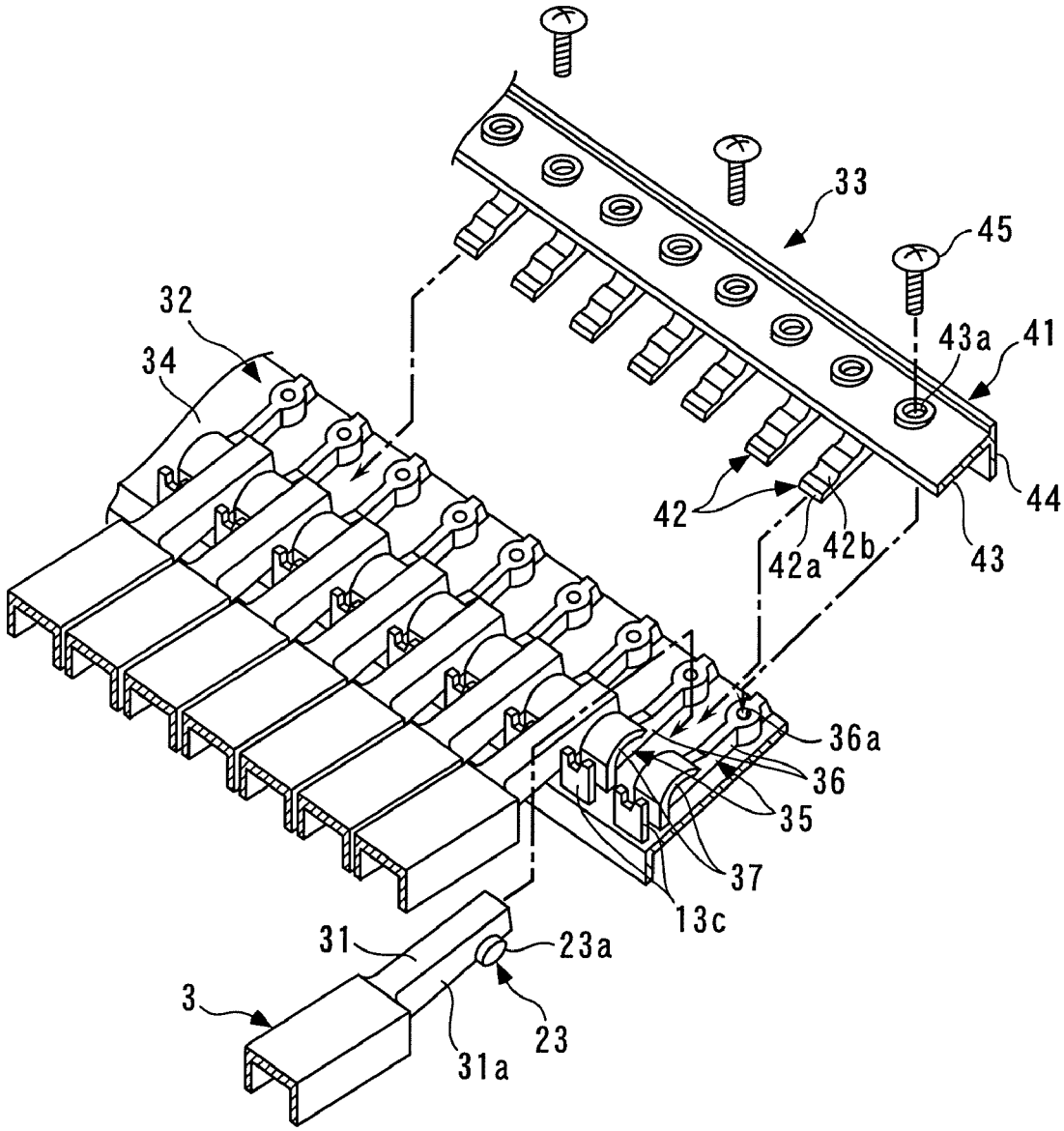
FIG. 4 is an exploded perspective view of FIG. 3.
Figure 5A:
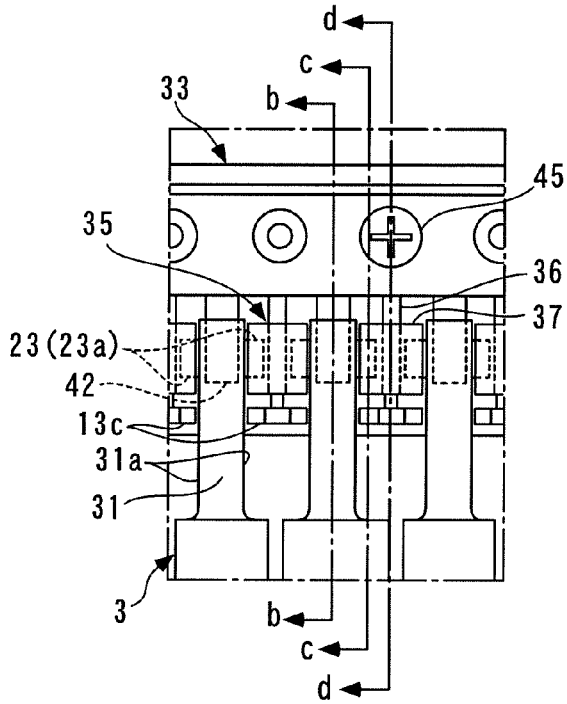
FIG. 5A is an enlarged plan view of part of a rear end of the keyboard device.
Figure 5B:
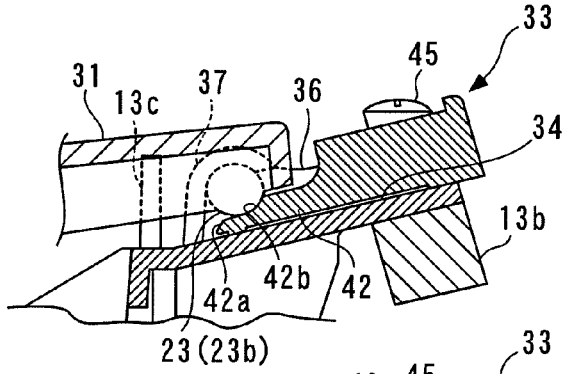
FIG. 5B is a sectional view taken along line b-b of FIG. 5A.
Figure 5C:
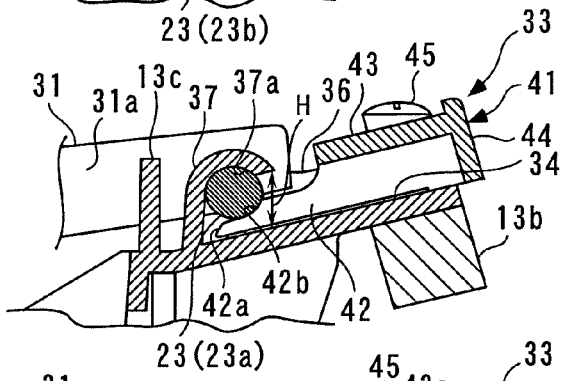
FIG. 5C is a sectional view taken along line c-c of FIG. 5A.
Figure 5D:
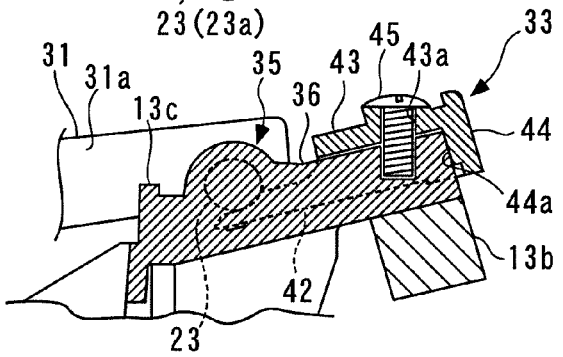
FIG. 5D is a sectional view taken along line d-d of FIG. 5A.

Next, the support structure for supporting the keys 3 by the keyboard chassis 2 and the method of mounting the keys 3 to the keyboard chassis 2 during assembly of the keyboard device 1 will be described with reference to FIGS. 2 to 5. FIG. 2 shows part of the keyboard device 1 in which a plurality of (eight in FIG. 2) keys 3 are supported on the keyboard chassis 2 in a state arranged side by side in the left-right direction. FIG. 3 is a perspective view of the keyboard device shown in FIG. 2, in which rear portions of the respective keys and associated components surrounding them are illustrated on an enlarged scale, and FIG. 4 is an exploded perspective view of FIG. 3. As shown in FIGS. 2 to 5, a rear portion 31 of each key 3 (hereinafter simply referred to as "the key rear portion 31") is formed to have a lateral width (width in the left-right direction) smaller than that of the remaining portion of the key 3 forward of the key rear portion 31. The key rear portion 31 is formed such that it slightly slopes upward toward the extreme rear end thereof. The key rear portion 31 is provided with the pivot shaft 23 as a pivot of the key 3, at a predetermined location thereof.

The pivot shaft 23 extends in the left-right direction, and is formed such that it has a circular cross section, with left and right ends 23*a* and 23*a* thereof protruding from respective side walls 31*a* and 31*a* of the key rear portion 31 by a predetermined length. Further, the pivot shaft 23 is formed such that a substantial lower half thereof protrudes downward with respect to the side walls 31*a* and 31*a* of the key rear portion 31 (see FIGS. 5B and 5C). The pivot shaft 23 of each key 3 is supported by the key support section 13*a* as described hereinbefore.

The key support section 13*a* of the chassis rear part 13 includes a chassis-side key support portion 32 (mounting portion) integrally formed with the chassis rear part 13 itself and a pivot shaft bearing member 33 removably mounted to the chassis-side key support portion 32. As shown in FIGS. 3 and 4, the chassis-side key support portion 32 has a guide surface 34 (mounting surface) having a laterally elongated rectangular shape in plan view and sloping downward and forward, and a plurality of key-separating support portions 35 (only nine of which are shown in FIG. 4) (first support portions) formed on the guide surface 34 in a manner arranged side by side in the left-right direction at predetermined spaced intervals.

As shown in FIGS. 4 and 5, each of the key-separating support portions 35 separates between the key rear portions 31 and 31 of respective two keys 3 and 3 adjacent to each other and supports the ends 23*a* and 23*a*, which are opposed to each other, of the pivot shafts 23 and 23 of the respective keys 3 and 3 at the same time. Specifically, the key-separating support portion 35 comprises a partition wall portion 36 (side wall portion) erected on the guide surface 34 and extending in the front-rear direction and a pivot shaft-engaging portion 37 formed on a front end of the partition wall portion 36. The partition wall portion 36 is disposed between opposed end faces of the respective pivot shafts 23, with a slight clearance from the partition wall portion 36 to each of the opposed end faces. Further, the partition wall portion 36 has a rear end thereof formed with an upwardly open mounting hole 36*a*, via which the pivot shaft bearing member 33 is screwed. On the other hand, the pivot shaft-engaging portion 37 has a lateral width larger than the thickness of the partition wall portion 36, with the partition wall portion 36 being disposed in the center thereof, and extends upward from the guide surface 34, then extending rearward, such that it is upward convexly curved. In short, the pivot shaft-engaging portion 37 is formed into an inverted J shape in side view. It should be noted that the distance H between the rear end of the pivot shaft-engaging portion 37 and the guide surface 34 is set to be slightly larger than the diameter of the pivot shaft 23, as shown in FIG. 5C.

The upper inner surface of the pivot shaft-engaging portion 37 is formed with an arcuate surface 37*a* (first arcuate surface) (see FIG. 5C) protruding from the partition wall portion 36, for sliding contact with the outer peripheral surface of the end 23*a* of the pivot shaft 23. The arcuate surface 37*a* has the same curvature as the outer peripheral surface of the pivot shaft 23, and is formed into a generally semicircular shape. Further, the pivot shaft-engaging portion 37 (arcuate surface 37*a*) is positioned such that a slight clearance is formed between the pivot shaft-engaging portion 37 and each of the side walls 31*a* of the respective key rear parts 31 opposed to each other.

On the other hand, similarly to the keyboard chassis 2, the pivot shaft bearing member 33 is a resin molded article in a predetermined shape formed e.g. by injection molding of a predetermined resin material (e.g. ABS resin). As shown in FIGS. 4 and 5, the pivot shaft bearing member 33 comprises a mounting portion 41 extending in the left-right direction, for mounting the pivot shaft bearing member 33 to the chassis-side key support portion 32, and a plurality of pivot shaft support portions 42 (second support portions) protruding forward from the mounting portion 41 and arranged side by side in the left-right direction at predetermined spaced intervals.

The mounting portion 41 is formed into a generally L shape in side view by a flat plate portion 43 having a laterally elongated rectangular shape in plan view and a rear wall portion 44 slightly protruding upward from a rear end of the flat plate portion 43 and extending downward from the same by a predetermined length. The flat plate portion 43 has a plurality of holes 43*a* (only eight of which are shown in FIG. 4) vertically extending therethrough and arranged along the length thereof at locations corresponding to the mounting holes 36*a* of the respective key-separating support portions 35. Further, the rear wall portion 44 has a front surface thereof provided with positioning portions 44*a* (see FIG. 5D) that slightly protrude forward for being brought into contact with the rear end faces of the partition wall portions 36 of the respective key-separating support portions 35, to thereby dispose arcuate surfaces 42*b*, referred to hereinafter, of the pivot support portions 42 concentrically with the arcuate surfaces 37*a* of the pivot shaft-engaging portions 37.

Each of the pivot shaft support portions 42 has a predetermined lateral width smaller than a distance between associated left and right key-separating support portions 35 and 35 adjacent to each other, and extends further forward than the flat plate portion 43 by a predetermined length. Further, the pivot shaft support portion 42 has a front end of the upper surface thereof formed with a sloping surface 42*a* sloping downward and forward and an arcuate surface 42*b* (second arcuate surface) formed rearward of the sloping surface 42*a*, for sliding contact with the outer peripheral surface of a central portion 23*b* of the associated pivot shaft 23. The arcuate surface 42*b* has the same curvature as the aforementioned arcuate surface 37*a* of the key-separating support portion 35, and is formed into a quarter circle shape.

The pivot shaft bearing member 33 constructed as above is screwed to the chassis-side key support portion 32 with a plurality of screws 45 (only three of which are shown in FIGS. 2 to 4) in a state where each of the pivot shaft support portions 42 is placed on the guide surface 34 of the chassis-side key support portion 32 and is positioned between the associated left and right key-separating support portions 35 and 35 adjacent to each other. In this case, the pivot shaft 23 of each key 3 has the opposite ends 23*a* and 23*a* thereof supported from above by the pivot shaft-engaging portions 37 and 37 of the respective left and right key-separating support portions 35 and 35, and the central portion 23*b* thereof supported from below by the pivot shaft support portion 42 of the pivot shaft bearing member 33, as shown in FIGS. 5A to 5D. As described above, each of the pivot shaft support portions 42 of the pivot shaft bearing member 33 cooperates with the associated pivot shaft-engaging portions 37 and 37 of the respective left and right key-separating support portions 35 and 35 to form a bearing for supporting the pivot shaft 23 of the associated key 3, and the bearing has a bearing surface formed by the arcuate surfaces 37*a* and 37*a* of the respective pivot shaft-engaging portions 37 and 37 and the arcuate surface 42*b* of the pivot shaft support portion 42. Thus, the key 3 is supported in a manner pivotally movable about the axis of the pivot shaft 23.

Next, the method of mounting the keys 3 to the keyboard chassis 2 during assembly of the keyboard device 1 will be described with reference to FIGS. 4 and 5A to 5D. First, the keys 3 are positioned on the keyboard chassis 2 in a manner arranged side by side in the left-right direction. Specifically, the key rear portion 31 of each key 3 is inserted in between the associated left and right key-separating support portions 35 and 35 and between the associated left and right rear guide portions 13*c* and 13*c*, from above as indicated by an arrow in FIG. 4, and then the pivot shaft 23 of the key 3 is placed on the guide surface 34. In this case, the pivot shaft 23 is positioned slightly rearward of the left and right pivot shaft-engaging portions 37 and 37. Then, the key 3 is slid slightly forward to thereby bring the opposite ends 23*a* and 23*a* of the pivot shaft 23 into engagement with the respective left and right pivot shaft-engaging portions 37 and 37. Each of the keys 3 is thus engaged with the associated pivot shaft-engaging portions 37 and 37, whereby the keys 3 are positioned on the keyboard chassis 2 in a manner arranged side by side in the left-right direction.

Then, the pivot shaft bearing member 33 is brought closer to the chassis-side key support portion 32 from above or from rear, as indicated by an arrow in FIG. 4, to thereby place each of the pivot shaft support portions 42 on the guide surface 34 in a manner positioned between the associated left and right key-separating support portions 35 and 35. Thereafter, the pivot shaft bearing member 33 is slid forward along the guide surface 34 to thereby bring the positioning portions 44*a* into abutment with the rear end faces of the respective key-separating support portions 35 (partition wall portions 36). In this case, each of the pivot shaft support portions 42 is inserted in between the pivot shaft 23 and the guide surface 34 while pushing the pivot shaft 23 slightly upward by the sloping surface 42*a* on the front end of the pivot shaft support portion 42. As a consequence, the pivot shaft 23 of each of the keys 3 has the opposite ends 23*a* and 23*a* thereof supported on the arcuate surfaces 37*a* and 37*a* of the pivot shaft-engaging portions 37 and 37 in the respective associated left and right key-separating support portions 35 and 35, and the central portion 23*b* thereof supported on the arcuate surface 42*b* of the associated pivot shaft support portion 42 of the pivot shaft bearing member 33, as shown in FIG. 5.

Then, the screws 45 are inserted into the respective holes 43*a* in the flat plate portion 43 of the pivot shaft bearing member 33 and are screwed into the respective associated mounting holes 36*a* in the chassis-side key support portion 32, whereby the pivot shaft bearing member 33 is properly positioned in the left-right direction. It should be noted that the pivot shaft bearing member 33 or the chassis-side key support portion 32 may be formed with a positioning portion for positioning the pivot shaft bearing member 33 in the left-right direction.

Thus, the pivot shaft bearing member 33 is screwed to the chassis-side key support portion 32, and the operation for mounting the keys 3 to the keyboard chassis 2 is completed. It should be noted that the keys 3 can be easily dismounted from the keyboard chassis 2 in a sequence reverse to the above-described mounting sequence.

As described above in detail, according to the present embodiment, the bearing for supporting the pivot shaft 23 of each key 3 is formed by the pivot shaft-engaging portions 37 and 37 of the respective associated left and right key-separating support portions 35 and 35 and the associated pivot shaft support portion 42 of the pivot shaft bearing member 33, so that it is possible to securely support the pivot shaft 23 in a well-balanced manner. Further, since each of the pivot shaft support portions 42 of the pivot shaft bearing member 33 is disposed between the guide surface 34 integral with the associated pivot shaft-engaging portions 37 and 37 and the associated pivot shaft 23, the bearing surface formed by the arcuate surfaces 37*a* and 37*a* of the pivot shaft-engaging portions 37 and 37 and the arcuate surface 42*b* of the pivot shaft support portion 42 can be immovably held in the radial direction, which makes it possible to easily form the bearing surface that stably supports the pivot shaft 23. Furthermore, clearances are formed, respectively, between each of the partition wall portions 36 of the respective key-separating support portions 35 and the opposed end face of the pivot shaft 23 and between the associated pivot shaft-engaging portions 37 and the side walls 31*a* and 31*a* of the key rear portion 31 opposed thereto, which makes it possible to prevent abrasion due to contact between each partition wall portion 36 and each pivot shaft 23 and between each pivot shaft-engaging portion 37 and each side wall 31*a*. What is more, the front guide 11*c* or 18*a* and the rear guides 13*c*, i.e. the front and rear guides spaced from each other in the front-rear direction suppress undesired unstable motion, such as lateral swing or tilt, of the associated key 3 during key depression. Thus, according to the keyboard device 1 of the present embodiment, it is possible to securely support each of the pivot shafts 23 in a well-balanced manner to thereby ensure smooth and stable pivotal motion of the associated key 3.

Further, since the chassis-side key support portion 32 of the keyboard chassis 2 to which the pivot shaft bearing member 33 is to be mounted is exposed outside during assembly of the keyboard device 1, a worker in charge of assembling the keyboard device 1 can easily view the position of the chassis-side key support portion 32 and mount the pivot shaft bearing member 33 to the chassis-side key support portion 32 by bringing the former close to the latter from above or behind. In addition, in the case of disposing of the electronic piano, the pivot shaft bearing member 33 can be dismounted from the chassis-side key support portion 32 in the sequence reverse to the sequence for mounting the pivot shaft bearing member 33 to the chassis-side key support portion 32, so that it is possible to remove the keys 3 from the keyboard chassis 2 with ease. Thus, according to the keyboard device 1 of the present embodiment, it is possible to increase the ease of assembly and disassembly of the keyboard device 1 in comparison with the prior art.

It should be noted that the present invention is by no means limited to the embodiment described above, but it can be practiced in various forms. As for the chassis-side key support portion 32 to which the pivot shaft bearing member 33 is to be mounted during assembly of the keyboard device 1, it is possible to adopt any construction insofar as the chassis-side key support portion 32 is configured to be exposed outside during mounting of the pivot shaft bearing member 33 such that the pivot shaft bearing member 33 can be easily mounted. Further, the number of the pivot shaft support portions 42 of the pivot shaft bearing member 33 is not particularly limited, but it is preferred that a single pivot shaft bearing member 33 has pivot shaft support portions 42 corresponding in number to one octave (i.e. twelve pivot shaft support portions 42). Further, the details of the construction of the keyboard device 1 and so forth described in the embodiment are given only by way of example, and various changes and modifications may be made without departing from the spirit and scope of the present invention.

What is claimed is:

1. A keyboard device for an electronic keyboard instrument, comprising:

a plurality of keys each extending in a front-rear direction and each having a pivot shaft extending at a rear end thereof in a left-right direction;

a keyboard chassis that includes a mounting portion, and a plurality of first support portions, each first support portion provided on a key-by-key basis to support a respective pivot shaft and to hold said keys in a state arranged side by side in the left-right direction; and a pivot shaft bearing member that includes a second support portion, which cooperates with each first support portion to form a bearing for supporting said pivot shaft to support each key in a manner pivotally movable about an axis of said pivot shaft and is removably mounted to said mounting portion, wherein during assembly of the keyboard device, in a state where each key is engaged with an associated one of said first support portions via said pivot shaft and is held on said keyboard chassis, said mounting portion remains exposed to outside before said pivot shaft bearing member is mounted thereto such that said pivot shaft bearing member can be mounted from above or rear.

2. The keyboard device according to claim 1, wherein said pivot shaft is formed such that ends thereof protrude from respective left and right side walls of said key, and wherein each first support portion comprises:

two side wall portions left and right erected on a mounting surface in a manner opposed to each other in the left-right direction with a predetermined spacing therebetween, and left and right first arcuate surfaces protruding from said two side wall portions, respectively, in a manner opposed to each other, for sliding contact with respective outer peripheral surfaces of said ends of said pivot shaft, and wherein said second support portion has a second arcuate surface opposed to said first arcuate surfaces for sliding contact with an outer peripheral surface of said pivot shaft, and is disposed between the mounting surface and said pivot shaft and placed on the mounting surface.

3. The keyboard device according to claim 2, wherein each side wall portion is disposed such that a clearance is formed between said each side wall portion and an end face of said pivot shaft opposed thereto, and each first arcuate surface is disposed such that a clearance is formed between a protruding end face thereof and a side wall of said key opposed thereto.

4. The keyboard device according to claim 2, wherein one of said mounting portion and said pivot shaft bearing member is provided with a positioning portion to be brought into contact with the other of said mounting portion and said pivot shaft bearing member when said pivot shaft bearing member is mounted to said mounting portion, to thereby dispose the second arcuate surface concentrically with the first arcuate surfaces.

5. The keyboard device according to claim 1, wherein said pivot shaft bearing member has a plurality of said second support portions.

6. The keyboard device according to claim 1, wherein said keyboard chassis further comprises two lateral swing-suppressing portions formed in association with each key in a manner spaced from each other in the front-rear direction to suppress lateral swing of said key during key depression.

* * * * *